US006676271B2

(12) United States Patent
Kohn et al.

(10) Patent No.: US 6,676,271 B2
(45) Date of Patent: Jan. 13, 2004

(54) HUMIDIFIER WITH LIGHTED TANK

(75) Inventors: Gabriel S. Kohn, Boca Raton, FL (US); Stacie Pacheco, Penbroke Pines, FL (US); Augusto A. Picozza, Boca Raton, FL (US); Suppawat Kosumsuppamala, Lake Worth, FL (US); Gina Bigge, St. Plantation, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 10/093,937

(22) Filed: Mar. 8, 2002

(65) Prior Publication Data

US 2003/0169588 A1 Sep. 11, 2003

(51) Int. Cl.[7] ..... F21V 33/00

(52) U.S. Cl. ..... 362/101; 362/96; 362/253; 261/79.2

(58) Field of Search ..... 362/96, 101, 253, 362/154, 155, 318; 261/81, 142, 79.2; 392/392

(56) References Cited

U.S. PATENT DOCUMENTS 3,443,083 A 5/1969 Curran
3,780,260 A 12/1973 Elsner
3,987,294 A 10/1976 Carlson
4,644,790 A * 2/1987 Mizoguchi ..... 73/293
4,714,984 A 12/1987 Spector
4,816,973 A 3/1989 Atalla et al.
5,165,778 A 11/1992 Matthias et al.
5,645,336 A 7/1997 Brown et al.
6,301,433 B1 10/2001 Montagnino et al.

OTHER PUBLICATIONS

Anonymous, "Hunter. Our Bright Ideas Light Up Your Sales," *HRN: The Newsletter of Home Products Retailing*, 1 page (Jan. 7, 2002).

* cited by examiner

*Primary Examiner*—Sandra O'Shea
*Assistant Examiner*—John Anthony Ward
(74) *Attorney, Agent, or Firm*—Lawrence J. Shurupoff

(57) ABSTRACT

A humidifier having a lighted water tank. A lamp illuminates the tank so that the water level of the tank is visible from across the room. The lamp may extend into a lens, which in one embodiment is faceted to aid in dispersing light into the tank. The illuminated tank may also serve as a night light.

28 Claims, 2 Drawing Sheets

HUMIDIFIER WITH LIGHTED TANK

FIELD OF THE INVENTION

The present invention relates generally to household products, and more particularly to humidifiers.

BACKGROUND OF THE INVENTION

To maintain a comfortable interior environment, humidity levels should typically be kept in a range from 30 to 50 percent in the winter and 40 to 50 percent in the summer. Lower levels of water vapor in the air can dry out and irritate skin, and higher levels may feel damp and can encourage mold and mildew, both of which can cause allergies and damage to a house.

For parts of the country where air is dry, humidifiers are often used to add water vapor into a home's air to increase the humidity of the house. Humidifiers are available, for example, as tabletop units, consoles, or units connected to central heating and cooling systems.

Contemporary tabletop humidifiers are designed to provide moisture for one room, while console or central humidifiers are configured to serve multiple rooms or a whole house. Tabletop and console models are relatively inexpensive, easy to connect and use, and are portable.

There are a number of different methods that humidifiers use to provide humidity. In general, however, the console and tabletop models provide moist air to a room by atomizing or evaporating water. For the console and tabletop models, the water is typically supplied by a tank that is part of the base for the humidifier, or that is attached to the base of the humidifier.

One type of humidifier is an ultrasonic humidifier. Such humidifiers apply ultrasonic energy to a water supply to atomize the water. The atomized water and water vapor is exhausted from the humidifier as a fog or mist using a fan, and the fog or mist evaporates into the surrounding air. Such humidifiers often include a switch or detector that shuts down the operation of the humidifier when the water is drained from the water tank.

Another type of humidifier blows dry air over a wet evaporator pad or pads. The pads are kept wet by having a portion of the pads submerged in the water tank, or are otherwise kept wet by water in the tank. In another model, an evaporator belt is used instead of the evaporator pad. Both of these models typically do not include an indicator or shutoff mechanism that operates when the tank is drained. Instead, the humidifiers typically continue to operate when the tank has been drained.

Although present humidifiers work well for their intended purpose, often it is difficult to determine when a water tank for one of the devices is out of water, or when it is approximately out of water. The inside of the tanks for the humidifiers may be hard to see, or the humidifier may be located somewhere, such as a dark corner, where inspection of the water level of the tank is difficult. Thus, for these reasons, the tanks for the humidifiers are often run dry, which of course eliminates the ability of the devices to produce humidity.

SUMMARY OF THE INVENTION

The present invention provides a humidifier having a lighted water tank. During operation of the humidifier, a lamp illuminates the tank so that the water level of the tank is visible from across the room. The illuminated tank may also serve as a night light.

In accordance with one aspect of the present invention, the humidifier includes a lamp that is mounted in the base. A water tank is mounted over the base and includes a translucent round bubble lens that fits over the lamp. The lamp illuminates the inside of the tank through the lens. In accordance with one aspect of the present invention, the lens is faceted so that light from the lamp is spread throughout the water tank. In addition, the lens is shaped so that the lamp extends at least partly into the tank. This feature further increases illumination of the tank.

The humidifier may be a mist variety, steam, or various other models that use a tank. If desired, two separate styles of operation may be provided, one in which the light is illuminated, and the other in which it is not.

Other advantages will become apparent from the following detailed description when taken in conjunction with the drawings, in which:

DETAILED DESCRIPTION

In the following description, various aspects of the present invention will be described. For purposes of explanation, specific configurations and details are set forth in order to provide a thorough understanding of the present invention. However, it will be apparent to one skilled in the art that the present invention may be practiced without the specific details. Furthermore, well-known features may be omitted or simplified in order to not obscure the present invention.

Figure 1:
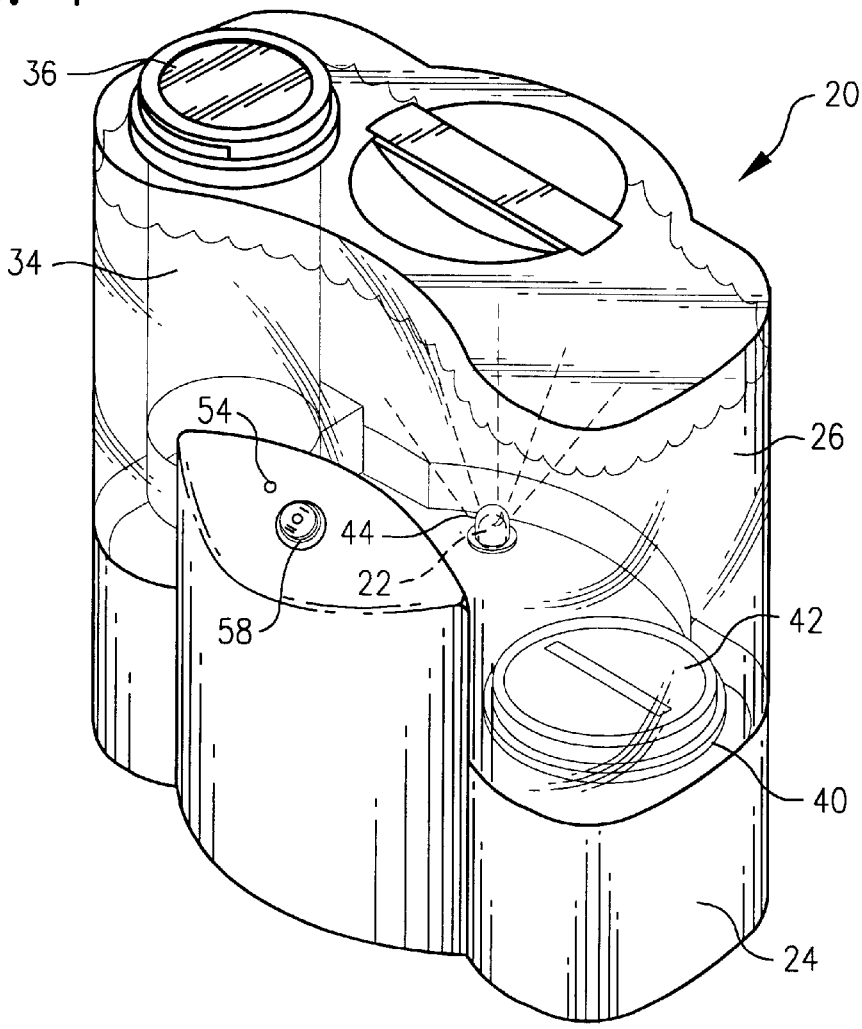
FIG. 1 is a front perspective view of a humidifier incorporating the present invention.

Referring now to the drawings, in which like reference numerals represent like parts throughout the several views, FIG. 1 shows a humidifier 20 incorporating the present invention. Briefly described, the humidifier 20 includes a light source, such as a lamp 22, mounted on a base 24 for the humidifier. The lamp 22 is arranged so that it may illuminate a water tank 26 for the humidifier.

The humidifier 20 shown in the drawings is an ultrasonic variety, such as the humidifier disclosed in U.S. Pat. No. 6,301,433 to Montagnino et al., owned by the assignee of the present invention and incorporated herein by reference. Although the reader may refer to the Montagnino patent for a description of an ultrasonic humidifier, the structure and operation of such a humidifier is briefly described for the reader's convenience.

Figure 2:
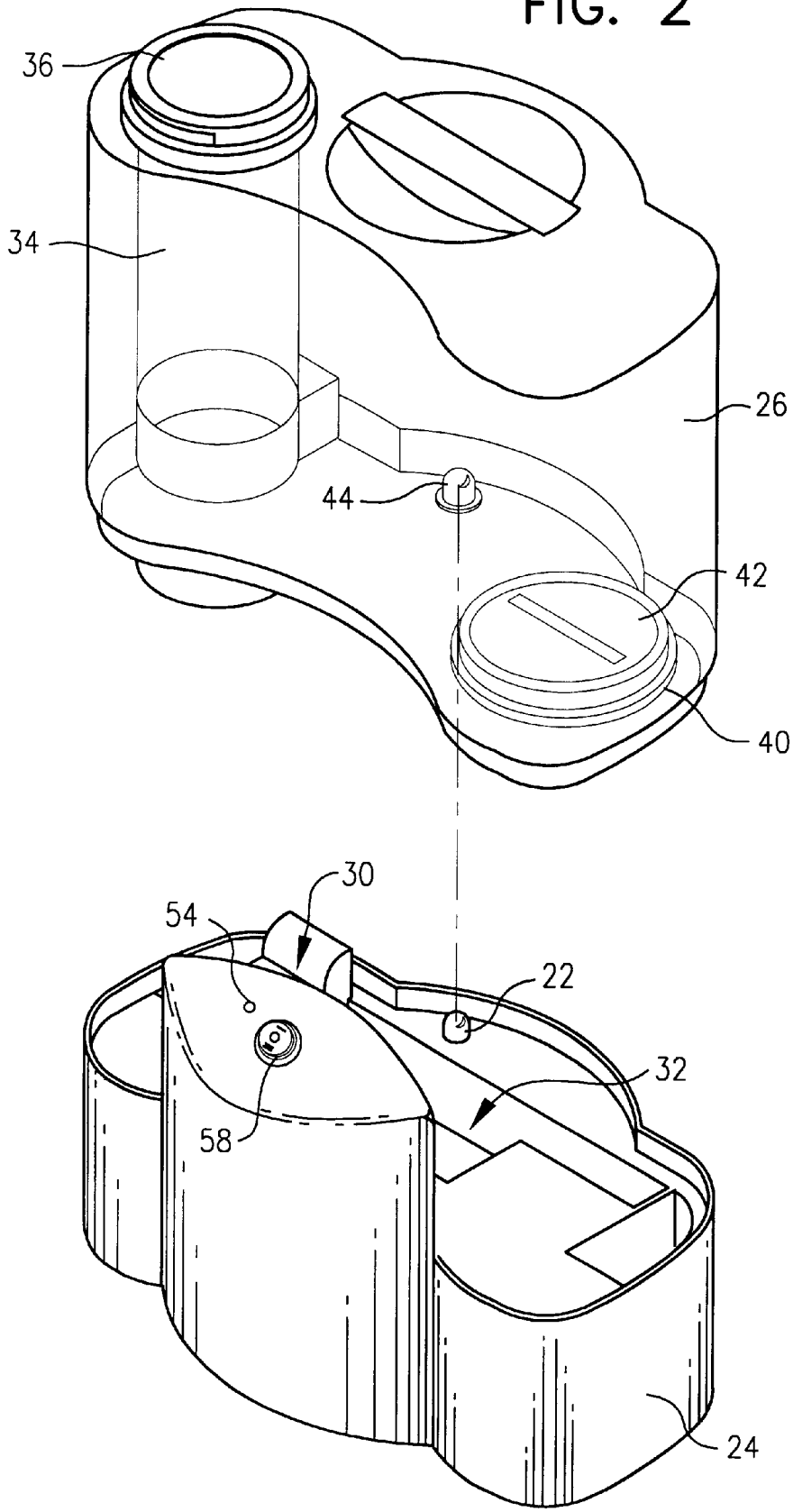
FIG. 2 is a side perspective view of the humidifier of FIG. 1, showing the tank of the humidifier removed from the base of the humidifier.

Methods of using ultrasonic energy to produce a water vapor mist are known, there are many variations in their design. As an example, the ultrasonic humidifier 20 includes, an atomizing chamber (generally shown at 30 in FIG. 2) for atomizing water. The humidifier 20 also includes a water tank chamber 32 (also FIG. 2) for accepting the water tank 26 and that supplies water to the atomizing chamber 30. If desired, the water tank 26 may be permanently affixed to the water tank chamber 32. The atomizing chamber 30 includes, for example, a vibration board (not shown, but known in the art) located on the bottom of the atomizing chamber. As is known in the art, an ultrasonic wave oscillator (not shown) applies an ultrasonic wave signal to the vibration board to atomize water in the atomizing chamber 30.

The vibration board includes, for example, an ultrasonic vibrator or transducer which uses ultrasonic energy to cause water to atomize. When the water tank 26 is installed, the atomizing chamber 30 exhausts a mist of water and water vapor to a vapor chamber 34 extending substantially vertically through the water tank 30. The vapor chamber 34 is, for example, a tube molded into the water tank 26 and acting as an exhaust outlet for atomized water and water vapor. A cap 36, having an outlet for discharging the atomized water, may be attached on the top of the vapor chamber 34.

In alternate embodiments, other types of ultrasonic vibrators or devices may be used to atomize the water and thus provide a source of water particles and possibly water vapor. In addition, the features of the present invention may be implemented in other designs of humidifiers, such as evaporator humidifiers or atomizers, steam-producing humidifiers, or any type of humidifier that utilizes a water tank. Thus, while the humidifier 20 in the drawings is described as an ultrasonic humidifier, the humidifier may be any type of humidity or mist producing device, and the present invention may be used to illuminate the tank of any such device. Furthermore, the aspects of the present invention may be used to illuminate any design of tank, including tanks that are mounted under, over, or on the side of the base for the humidifier, and tanks that are formed integral with the base. To this end, by using the term "base," we mean a structure that houses at least some of the humidifying mechanisms for the humidifier. However, it is to be understood that the humidifying mechanisms may be formed integral with a water tank that may be illuminated in accordance with the present invention.

The water tank 26 in the shown embodiment includes a fill opening 40 at its bottom and a fill cap 42, which screws onto, or otherwise connects with, the fill opening 40. In use, a user may fill the water tank 26 via the fill opening 34.

Although not shown, the water tank 26 may include a valve or other structure that seals an opening in the bottom of the water tank while the tank is separate from the base 24 for the humidifier 20. The valve may be opened, for example by a valve rod, when the tank is placed on the base 24. The humidifier 20 also may include a device or circuit for detecting when the water tank 26 is empty and for halting the humidifier 20 on such an occurrence.

In the embodiment shown, the water tank 26 may be constructed from synthetic resin, glass, or another suitable material. However, preferably at least a portion of the tank is transparent or at least translucent, whereby the tank permits light transmission.

During operation, the lamp 22 illuminates at least a portion of the water tank 26. In accordance with one aspect of the invention, the water tank 26 includes a translucent portion positioned so that the lamp 22 may illuminate through a side or the bottom of the water tank to the inside of the water tank. In this manner, the water within the water tank 26, as well as the water level of the water tank 26, is illuminated by the lamp 22. In addition, it is desirable that at least a portion of the outer periphery of the water tank 26 be translucent, so that the light that has entered the water tank may be visible from the outside of the water tank.

The portion of the water tank 26 that is translucent is a design choice of the manufacturer, but in one embodiment, the visible outside periphery of the tank is translucent, thereby providing exemplary illumination of the water tank. In another embodiment, only a vertical strip of the water tank 26 is translucent, so that minimum illumination is provided, but the water level of the tank is visible. Alternatively, only the bottom of the tank 26 may be translucent, allowing limited illumination and a visual indication of whether the water level in the tank 26 is low. Other combinations of translucent portions of the tank 26 with portions that prevent light transmission may be used.

The lamp 22 may be any of various devices for producing light. For example, the lamp 22 may be a conventional incandescent light bulb, e.g., a 25 W bulb. Alternately the lamp 22 may be another type of light producing device, such as an LED, a fluorescent lamp, or any other suitable device that is capable of generating light. Also, although the lamp 22 is shown as being mounted on the base 24, the lamp 22 may be mounted on or in the tank 26, or may be otherwise suitably arranged so that the lamp 22 illuminates the water tank 26.

In the embodiment shown, a translucent lens or aperture 44 is provided on the bottom of the tank for permitting the light produced by the lamp 22 to enter the water tank 26. The lens 44 may be, for example, a translucent convex bubble that fits over the lamp 22. The lens 44 may be constructed of any translucent material, such as a synthetic resin or glass. In accordance with one aspect of the present invention, the lens 44 is formed integrally with the bottom of the water tank 26, but the lens could be formed as a separate element.

In an alternate embodiment, the lens 44 is faceted, which aids in dispersing light throughout the tank. The faceted lens may be made of a clear plastic, for example, and may include a dimpled pattern thereon.

In accordance with another aspect of the present invention, the lens 44 is convex in shape and extends into the water tank 26. The convex shape of the lens 44 permits the tip of the lamp 22 to extend within the interior of the tank 26. For example, in the embodiment shown in the drawings, the lamp 22 protrudes above the bottom of the water tank 26. In this manner, the light emitted by the lamp 22 may be illuminated in multiple directions within the tank 26, providing exemplary illumination.

As an alternative, a lens may not be used, and the lamp 22 may be mounted so that it illuminates the tank 26, e.g., mounted adjacent the tank. Also, in an alternate embodiment, the lamp 22 and lens 44 may be positioned elsewhere on the humidifier 20; for instance, the lens may occupy a portion of the vapor chamber 34 through the water tank 26 or may be located on the side of the water tank 26. In any event, in accordance with one aspect of the invention, the lens 44 is positioned so that it permits the lamp 22 to illuminate the interior of the water tank 26.

Figure 3:
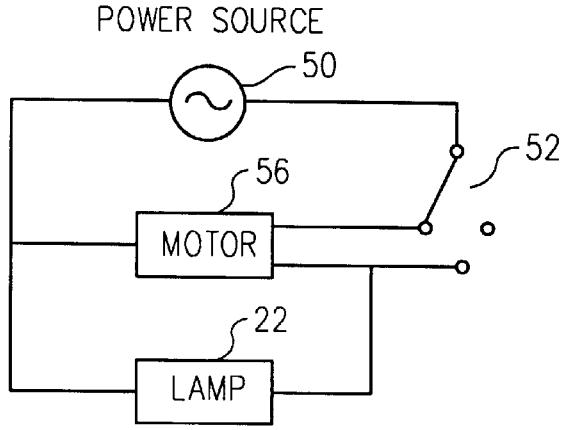
FIG. 3 is a simplified representation of a circuit diagram for the humidifier of FIG. 1.

The humidifier 20 also includes a power cord (not shown, but known in the art) connecting to a conventional household power supply (shown generally at 50 in FIG. 3), a three-pole switch 52, and an on/off indicator 54 (FIG. 1), which may be, for example, a lamp. The power cord may be inserted into a common household electrical supply which in North America provides 120 V AC. However, the humidifier 20 may be configured to attach to other power supplies having other voltages, such as those of the various configurations used in Europe or Africa, or may be configured to run from a DC or other power source. If desired, the humidifier 20 also may include controls for varying the rate of mist production, the air blower speed, or the level of illumination produced by the lamp 22.

The three-pole switch 52 is operated by a button 58 (FIG. 1) on the base 24. In a first position, the three-pole switch 52 permits power to flow into a motor 56, or to other electronically operated components that are configured to provide operation of the humidifier 20. In a second position, the three-pole switch 52 permits power to flow into the motor 56 and the lamp 22, and in the third position the three-pole switch 52 shuts off operation of the humidifier. In this manner, the three-pole switch 52 permits the humidifier to be operated with or without the lamp 22 being lit (e.g., in the first or second positions). If desired, an additional or alternate function may be provided whereby the lamp illuminates the tank while the humidifier is not operating. The three-pole switch 52 is described as an example, and the functions of the lamp and the humidifier may be turned off and on by more than one switch. Also, as used herein, switch is used to denote any component that is capable of turning off or on a device.

In accordance with one aspect of the invention, the lens 44 and/or the outer shell of the water tank 26 may be colored, and thus may filter the light from the lamp 22 to produce a colored illumination of the water tank 26, causing the tank to appear colored and glowing. The lens 44 or the tank 26 may be colored by being manufactured from colored acrylic; for example, red or blue acrylic. Alternately, the lamp 22 may be colored by using a colored filter or by being produced by a colored light-producing device such as an LED or colored light bulb.

To operate the humidifier 20, according to an exemplary embodiment of the present invention, a user fills the water tank 26, plugs the power cord into a conventional wall outlet, and turns the three-pole switch 52 to either the first or second positions. In the first or second position, the operation of the humidifier commences, and steam, water vapor, or mist is produced. In the second position, the lamp 22 is lit, and illuminates the water tank 26. If the lens 44 and/or the water tank are colored, the water tank 26 glows with an attractive colored light.

Preferably the beam produced by the lamp 22 is powerful enough so that the illuminated water tank 26 may serve as an attractive night light. In addition, the illumination of the water tank 26 helps to easily determine the water level of the water tank by visual inspection, especially during the night.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. A humidifier, comprising:

a water tank designed to hold water therein, the water tank further comprising a lens configured and arranged to permit light to pass into the water tank; and a lamp mounted to illuminate the water tank through the lens.

2. The humidifier of claim 1, wherein a humidifier having water tank is formed at least partly of a translucent material so that light may pass from an inside of the water tank to an outside of the water tank.

3. The humidifier of claim 2, wherein the lamp is configured and positioned to illuminate at least a portion of an interior of the water tank.

4. The humidifier of claim 3, wherein an outer periphery of the water tank comprises the translucent material.

5. The humidifier of claim 1, wherein the lens is faceted.

6. The humidifier of claim 1, wherein the lens is convex in shape and extends into an interior of the water tank, and wherein the lamp extends into the lens and at least partly into the tank.

7. The humidifier of claim 1, further comprising a lens on the tank configured and arranged to permit light from the lamp to pass into the water tank.

8. The humidifier of claim 7, wherein the lens is faceted.

9. The humidifier of claim 7, wherein the lens is convex in shape and extends into an interior of the water tank, and wherein the lamp extends into the lens and at least partly into the tank.

10. The humidifier of claim 1, further comprising at least one switch for turning on the lamp.

11. The humidifier of claim 10, wherein the at least one switch is configured to turn on the humidifier.

12. The humidifier of claim 11, wherein the at least one switch is configured to alternatively (1) turn on the lamp with operation of the humidifier and (2) turn on the operation of the humidifier without turning on the lamp.

13. The humidifier of claim 10, wherein the at least one switch is configured to alternatively turn on the lamp with operation of the humidifier or without operation of the humidifier.

14. A humidifier, comprising:

a humidifier having a base;

a lamp mounted in the base;

a water tank associated with the base so that the lamp illuminates the water tank; and wherein the water tank further comprises a lens configured and arranged to permit the light emitted by the lamp to pass into the water tank.

15. The humidifier of claim 14, wherein water tank is formed at least partly of a translucent material so that light may pass from the inside of the water tank to the outside of the water tank.

16. The humidifier of claim 15, wherein the lamp is configured and positioned to illuminate through the translucent material to at least a portion of the interior of the water tank.

17. The humidifier of claim 16, wherein the outer periphery of the water tank comprises the translucent material.

18. The humidifier of claim 14, wherein the lens is faceted.

19. The humidifier of claim 14, wherein the lens is convex in shape and extends into an interior of the water tank, and wherein the lamp extends into the lens and at least partly into the tank.

20. The humidifier of claim 14, wherein the water tank comprises the lens, and the lens fits over the lamp.

21. The humidifier of claim 14, further comprising a lens on the tank configured and arranged to permit light from the lamp to pass into the water tank.

22. The humidifier of claim 21, wherein the lens is faceted.

23. The humidifier of claim 21, wherein the lens is convex in shape and extends into an interior of the water tank, and wherein the lamp extends into the lens and at least partly into the tank.

24. The humidifier of claim 21, wherein the water tank comprises the lens, and the lens fits over the lamp.

25. The humidifier of claim 14, further comprising at least one switch for turning on the lamp.

26. The humidifier of claim 25, wherein the at least one switch is configured to turn on the humidifier.

27. The humidifier of claim 26, wherein the at least one switch is configured to alternatively (1) turn on the lamp with operation of the humidifier and (2) turn on the operation of the humidifier without turning on the lamp.

28. The humidifier of claim 26, wherein the at least one switch is configured to alternatively turn on the lamp with operation of the humidifier or without operation of the humidifier.

* * * * *